US008251271B2

(12) United States Patent
Nakano et al.

(10) Patent No.: US 8,251,271 B2
(45) Date of Patent: Aug. 28, 2012

(54) NAILING MACHINE

(75) Inventors: Yoshihiro Nakano, Ibaraki (JP); Hiroyuki Oda, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 98 days.

(21) Appl. No.: 12/620,733

(22) Filed: Nov. 18, 2009

(65) Prior Publication Data

US 2010/0133313 A1 Jun. 3, 2010

(30) Foreign Application Priority Data

Nov. 28, 2008 (JP) ..... 2008-305673

(51) Int. Cl.
*B25C 1/00* (2006.01)

(52) U.S. Cl. ..... 227/8; 227/119; 227/120; 227/123; 227/136; 227/138; 227/139

(58) Field of Classification Search ..... 227/119, 227/120, 123, 136, 138–139, 8
See application file for complete search history.

(56) References Cited

U.S. PATENT DOCUMENTS

| | | | | |
|---|---|---|---|---|
| 3,567,098 | A * | 3/1971 | Maynard | 227/5 |
| 3,809,307 | A * | 5/1974 | Wandel et al. | 227/8 |
| 4,189,081 | A * | 2/1980 | Combette et al. | 227/10 |
| 6,056,181 | A * | 5/2000 | Chuang | 227/8 |
| 7,328,826 | B2 * | 2/2008 | Shkolnikov | 227/8 |
| 7,513,403 | B2 * | 4/2009 | Fujimoto | 227/8 |
| 7,909,218 | B2 * | 3/2011 | Jiang | 227/132 |
| 2006/0169735 | A1 * | 8/2006 | Wen | 227/8 |

FOREIGN PATENT DOCUMENTS

JP 2008-264906 A 11/2008

* cited by examiner

*Primary Examiner* — Brian D Nash
*Assistant Examiner* — Michelle Lopez
(74) *Attorney, Agent, or Firm* — Kenealy Vaidya LLP

(57) ABSTRACT

According to an aspect of the present invention, there is provided a nailing machine, including: a drive unit that drives a blade to strike a nail; a blade guide that includes a guide groove to guide the blade; a guide plate that is attached on the blade guide to cover the guide groove; and a magazine that is held with respect to the blade guide and that feeds a nail to the guide groove, wherein the nailing machine further includes a blade fixing unit that limits a movement of the blade when the guide plate is detached.

6 Claims, 7 Drawing Sheets

NAILING MACHINE

CROSS-REFERENCE TO RELATED APPLICATIONS

This application is based upon and claims a priority from prior Japanese Patent Application No. 2008-305673 filed on Nov. 28, 2008, the entire contents of which are incorporated herein by reference.

BACKGROUND OF THE INVENTION

1. Field of the Invention

The present invention relates to a nailing machine which can drive connected nails sequentially and, specifically, the invention relates to a nailing machine which, when it is clogged with a nail, permits easy removal of the clogging nail.

2. Description of the Related Art

Conventionally, there has been widely used a construction method in which, in order to mount mounting members for interior finishing, that is, finishing construction materials such as skirting boards and crown moldings, after the mounting members are bonded with an adhesive, a finishing nail including a small nail head having a T-shaped head diameter of 1~2 mm is struck into the mounting members. However, recently, in order to further improve the finished state of the mounting members after nailed, there has been increasing a method which uses a no-head nail instead of the finishing nail having the T-shaped head diameter. As regards the thickness of the shaft of the no-head nail, in order to make the no-head nail inconspicuous and provide a better finishing, for example, there is used a no-head nail having a shaft diameter of 0.6~0.7 mm. Generally, about 100 pieces of no-head nails are arranged side by side and connected together, the connected nails are set in the magazine of a nailing machine, and they are struck into the mounting members by the nailing machine.

As such nailing machine for striking the no-head nails, there has been widely used a nailing machine which uses compressed air as the power source thereof. However, recently, there has been proposed a nailing machine which uses an electric motor not the compressed air as the power source thereof. For example, in JP-2008-264906-A, there is disclosed a nailing machine which strikes nails into a nailing-receiving member such as a wall using a battery as the power source thereof. In this nailing machine, a coil spring is compressed using an electric motor, and the compressed state of the compressed coil is released to thereby move a hammer connected to the coil spring, so that nails to be situated on the leading end of the hammer can be struck into the nailing-receiving member.

In a nailing machine, when there is used a nail having a small diameter, a nailing-receiving area is hard and a nailing-operation block member such as metal exists in a nailing-receiving member, there is a possibility that the nail cannot be struck properly but the nail can be bent and stopped up within the leading end portion of the nailing machine to clog the nailing machine. When such nail clogging phenomenon occurs, a guide plate disposed in the nail ejection portion of the nailing machine must be removed and the clogging nail must be removed; and, after then, the guide plate must be mounted again into the ejection portion. When the guide plate is removed and the nail blocking the movement of the blade is moved or removed, in some cases, a blade can be moved suddenly due to the repulsive force of a coil spring. In order to prevent the sudden movement of the blade, there is proposed use of an operation to fix the blade. However, when there is used a method in which an operator carries out such blade fixing operation, it takes time and labor to fix the blade, resulting in the lowered efficiency of the operation. In view of this, there has been demanded the development of a nailing machine which allows an operator to carry out easily the operation to remove the nail clogging state thereof.

SUMMARY OF THE INVENTION

An object of the invention is to provide a nailing machine which can facilitate the removal of a nail stopped up between a blade and guide grooves formed in the blade.

Another object of the invention is to provide a nailing machine including a blade fixing unit which, when a guide plate is removed, can limit the movement of the blade.

The exemplary aspects of the present invention are as follows.

According to an aspect of the invention, there is provided a nailing machine which includes: a drive unit for driving a blade for striking a nail; a blade guide for guiding the blade; a guide plate to be mounted in such a manner that it covers a guide groove formed in the blade guide; and, a magazine fixed to the blade guide for feeding a nail to the guide groove, wherein the nailing machine further includes a blade fixing unit for limiting the movement of the blade when the guide plate is removed. This blade fixing unit may be preferably structured such that it limits the movement of the blade at least in the nail striking direction. Also, at a position adjoining the guide plate, there is mounted a plate member which can be mounted onto the blade guide; and, the blade fixing unit is interposed between the guide plate and plate.

According to another aspect of the invention, the blade fixing unit includes a contact member and a spring for moving the contact member; and, the spring and the contact member are disposed in a space defined by the blade, guide plate and plate, and are covered with a lock plate which can be fixed to the plate. As the contact member, there can be used, for example, a needle roller, a metal ball and a pressing member. In such surface of the lock plate as can be contacted with the contact member, there is formed an inclined surface portion in such a manner that the distance between the inclined surface portion and the surface of the blade decreases as the inclined surface portion goes in the nail ejection direction. The contact member can be moved along the inclined surface portion due to the operation of the spring and thus can be contacted with the inclined surface portion and the blade, thereby fixing the movement of the blade. The inclined surface portion may preferably be formed such that it has an angle of approx. 10° with respect to the blade surface.

According to still another aspect of the invention, a space to be formed between the guide plate and plate is specifically formed between a hole portion formed in a portion of the plate and a projecting portion to be provided on the guide plate. And, when the guide plate is fixed to the blade guide, the projecting portion moves the contact member against the force of the spring to thereby remove the limit of the movement of the blade set by the blade fixing means.

According to a first aspect of the invention, since there is provided the blade fixing unit which, when the guide plate is removed, can limit the movement of the blade, when trying to remove the nail stopped up between the blade and the guide groove thereof, there is no possibility that the blade can move downward energetically, thereby being able to prevent the clogging nail from flying around.

According to a second aspect of the invention, since the blade fixing unit limits the movement of the blade only in the nail striking direction, the blade can be moved in the opposite direction to the nail striking direction, which can facilitate the nail removing operation.

According to a third aspect of the invention, since the blade fixing unit is interposed between the guide plate and plate, it can be mounted onto an existing member. In this manner, since no special member is additionally used in order to provide the blade fixing unit, the blade fixing unit can be realized at a low cost.

According to a fourth aspect of the invention, since the blade fixing unit is made of a contact member and a spring for moving the contact member, the blade fixing unit can be realized using simple members.

According to a fifth aspect of the invention, in such surface of the lock plate as faces the contact member, there is formed an inclined surface portion in such a manner that the distance between it and the blade surface decreases as it goes in the nail injecting direction. And, due to the operation of the spring, the contact member is moved along the inclined surface portion and is thus contacted with the inclined surface portion and blade, thereby being able to fix the movement of the blade positively.

According to a sixth aspect of the invention, since the inclined surface portion has an angle of approx. 10° with respect to the blade surface, the lock plate may only include an inclined surface having a small angle, which makes it possible to reduce an increase in the manufacturing cost of the nailing machine.

According to a seventh aspect of the invention, when the guide plate is fixed to the blade guide, the projecting portion moves the contact member against the force of the spring to thereby remove the limit of the blade set by the blade fixing unit. Owing to this, when removing the nail clogging state of the nailing machine, the fixation of the blade can be removed automatically and thus the nailing machine can be easy to use.

According to an eighth aspect of the invention, since the contact member is a needle roller or a metal ball, the blade fixing unit can be realized using an inexpensive member.

The above-mentioned objects, other objects and new features of the invention will be apparent from the following description of the specification and the accompanying drawings.

BRIEF DESCRIPTION OF THE DRAWINGS

FIG. 7A is a partial back view of the blade 14, and FIG. 7B is a bottom view of the blade 14.

DETAILED DESCRIPTION OF THE INVENTION

Description will be given below of a nailing machine according to an embodiment with reference to a nailing machine of an electric type. Also, in the following drawings, the same parts are given the same designations and thus the duplicate description thereof will be omitted. Further, in the following description of the present specification, the forward, backward, upward and downward directions are respectively such directions as are shown in FIG. 1.

Figure 1:
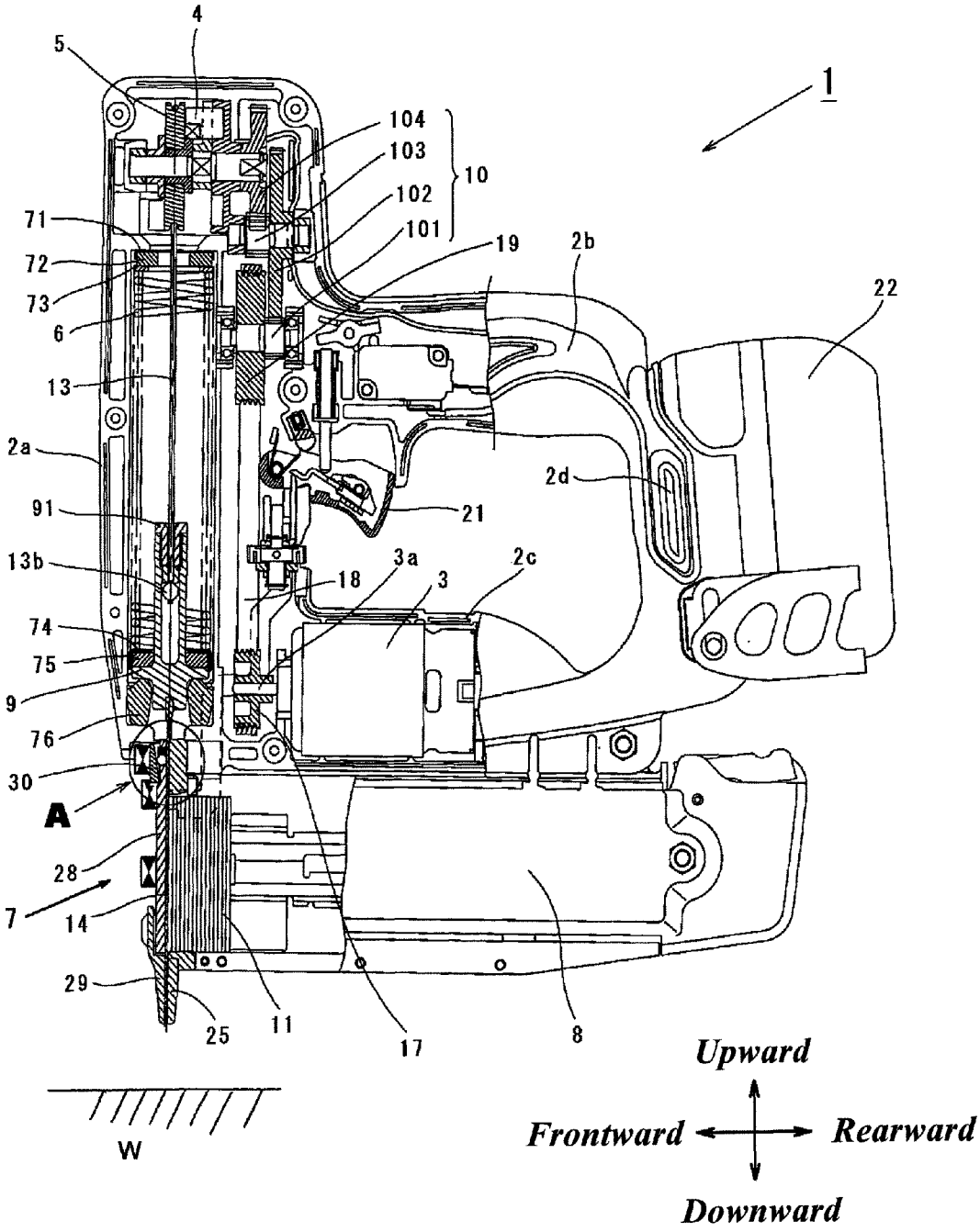
FIG. 1 is a section view of a nailing machine according to an embodiment of the invention.

FIG. 1 is a section view of a nailing machine according to the embodiment. The present nailing machine uses an electric motor 3 as the drive source thereof, and it strikes a nail 11 serving as a fixing member into a driven member W such as timber or gypsum board. The nailing machine 1 includes a housing 2 (2*a*, 2*b*, 2*c*, 2*d*), the motor 3, a clutch mechanism 4, a transmission portion, a coil spring 6, an ejection portion 7, and a magazine 8. A plunger 9, when it is energized by the coil spring 6, strikes the nail 11 in the ejection direction (in the downward direction).

The housing 2 is made of polyamide-system synthetic fibers or resin such as polycarbonate and includes four portions: specifically, a body portion 2*a* for forming a space in which the plunger 9 can move in the vertical direction; a handle portion 2*b* to be gripped by an operator; a motor holding portion 2*c* for incorporating the electric motor 3 therein; and, a battery holding portion 2*d* for holding a battery therein. The housing 2 is divided into two parts by a plane which passes in the moving direction of the plunger 9. To produce an assembled housing 2, the two divided housing parts may be put together and, after then, they may be fixed together using screws (not shown). The handle portion 2*b* is set in such a manner that it extends vertically from the upper portion of the body portion 2*a* and, in the neighborhood of the connecting portion of the handle portion 2*b* to the body portion 2*a*, there is provided a trigger 21 which is used to carry out an on/off control operation on the motor 3. The motor holding portion 2*c* of the housing 2 is disposed in the neighborhood of the lower end of the body portion 2*a* in such a manner that it extends perpendicularly to the substantially cylindrical body portion 2*a* and substantially in parallel to the handle portion 2*b*. In the handle portion 2*b* and motor holding portion 2*c*, on the opposite side of the body portion 2*a*, there is formed the battery holding portion 2*d* in such a manner that it connects together the two portions 2*b* and 2*c*; and, on the battery holding portion 2*d*, there is disposed a battery 22 which can be removably mounted onto the battery holding portion 2*d*. The battery 22 may be a secondary cell such as a nickel-cadmium battery or a lithium ion battery.

The motor 3 is disposed horizontally within the motor holding portion 2*c* in such a manner that the rotation shaft 3*a* thereof can extend perpendicularly to a direction (a downward direction) where the nail 11 is struck. On the rotation shaft 3*a*, there is provided a first pulley 17, while the rotation force of the first pulley 17 is transmitted to a second pulley 19 by a belt 18 which is extended upwardly from the first pulley 17. The second pulley 19 is supported upwardly of the body portion 2*a* by two bearings in such a manner that the first pulley 17 and rotation shaft 3*a* can extend in parallel to each other. The belt 18 is, for example, a V belt and is disposed in such a manner that the direction of the major axis of the elliptic shape thereof can extend in parallel to the coil spring 6.

The rotation force transmitted to the second pulley 19 is then transmitted through a deceleration mechanism 10 to the clutch mechanism 4. The deceleration mechanism 10 includes a first gear 101 provided coaxially with the second pulley 19 and rotatable at the same speed with the second pulley 19, a second gear 102 in meshing engagement with the first gear 101, a third gear 103 provided coaxially with the second gear 102 and rotatable at the same speed therewith, and a fourth gear 104 in meshing engagement with the third gear 103. On the same axis of the fourth gear 104, there is provided the clutch mechanism 4; and the clutch mechanism 4 controls whether the rotation force of the fourth gear 104 is transmitted to a drum 5 or cut off.

The above-mentioned structure reduces the number of rotations of the motor 3 and transmits such reduced number of rotations to the clutch mechanism 4. However, the structures of the transmission mechanism and deceleration mechanism are not limitative but there may also be used arbitrary deceleration mechanism and transmission mechanism, provided that they can rotate the drum 5 at a desired torque and at a desired number of rotations.

Referring to the structure of the clutch mechanism 4, one end (input side) thereof is connected to the fourth gear 104 in such a manner that it can be rotated coaxially, while the other end (output side) thereof is connected to the drum 5 in a coaxially rotatable manner. In the clutch mechanism 4, until the input side thereof is rotated by a given angle (=an angle necessary for the plunger 9 to arrive at the top dead center; that is, about 270° in the rotation angle, which will be discussed later), while the output side thereof is connected, the clutch mechanism 4 is rotated coaxially and integrally with the drum 5. In a state where the input side of the clutch mechanism 4 is rotated by a given angle, the output transmission from the input side of the clutch mechanism 4 to the output side thereof is cut off, whereby the drum to be connected to the output side of the clutch mechanism 4 is allowed to rotate freely.

The transmission portion includes, as its main portions, a wire 13 wound on the outer peripheral portion of the drum 5 liftable in the upward direction, and the plunger 9 to be connected to the leading end (lower end) of the wire 13. The drum 5 is a substantially disk-shaped pulley member which includes grooves formed in the outer peripheral portion for guiding the wire 13; and, the drum 5 is disposed in such a manner that the tangent of the circular-shaped drum 5 can coincide with the axis of a blade 14 which is used to strike a nail. That is, the center of rotation of the drum 5 does not exist on the axis of the blade 14. To the two ends of the wire 13, there are fixed round metal balls 13*b* which function as members for preventing the wire 13 against removal. One of the metal balls is secured to a mounting hole formed in the inner peripheral portion of the drum 5, and the wire 13 extending from this metal ball is guided into the groove which is formed in the outer peripheral portion of the drum 5, whereby the wire 13 can be mounted in such a manner that it extends downward from the drum 3. The wire 13 may be structured by bundling together fiber-like steel wires and, preferably, the surface of the wire 13 may be coated with resin.

The plunger 9 holds the blade 14 used to strike a nail into a nailing-receiving member W and, on receiving a spring force produced by the coil spring 5, the plunger 9 transmits the spring force to the blade 14. In the upper internal portion of the plunger 9, there is formed a cylindrical-shaped internal space; and, the metal ball 13*b* existing on the lower end side of the wire 13 is fixed to the plunger 9 by a cap 91 in such a manner that it can exist in such internal space. To fix the metal ball 13*b* to the plunger 9, preferably, the male screw of the cap 91 may be threadedly engaged with a female screw formed in the cylindrical internal space. The plunger 9 is situated in the lower side end portion of the coil spring 6 and includes an energizing portion existing lower than the center thereof in the vertical direction and increasing in diameter. On the upper side of the energizing portion, there is mounted a metal-made washer 74 through an elastic member 75, while the washer 74 is contacted with the coil spring 6. As for the structure of the washer 74, the upper surface thereof has a ring-like shape and can receive the lower end portion of the coil spring 6; and, the circumferential portion thereof extends downwardly, whereby the washer 74 is formed to have a cylindrical shape. Therefore, the washer 74 can store the elastic member 75 therein and, further, the cylindrical-shaped outer wall of the washer 74 can be contacted with the inner wall of a cylinder portion, thereby being able to prevent the plunger 9 from coming into direct contact with the inner wall of the cylinder portion and thus prevent the plunger 9 against abrasion.

Since the wire 13 penetrates through the coil spring 6 and the lower end portion thereof is fixed to the plunger 9, by pulling up the wire 13 in the upward direction, the plunger 9 can be moved upwardly while compressing the coil spring 6. Here, a position where the plunger 9 is normally situated while it is energized by the coil spring 6, that is, the state of the plunger 9 where the lower end of the energized portion of the plunger 9 is contacted with a bumper 76 (the state shown in FIG. 1) is defined as the bottom dead center of the plunger 9; and, a position where the energized portion of the plunger 9 is pulled and moved most upwardly is defined as the top dead center of the plunger 9. Within the housing 2, on the lower side of the energized portion of the plunger 9, there is provided a bumper 76 which is made of soft rubber or resin such as urethane.

In the neighborhood of the upper end portion of the coil spring 6, there are disposed a damper guide 71, an elastic member 72 and an upper washer 73 sequentially in this order from the inner wall of the housing 2, while the upper end portion of the spring 6 is contacted with the lower surface of the upper washer 73. The damper guide 71 is a protection member which protects the elastic member 72 from coming into contact with the inner wall of the housing 2 and thus protects the elastic member 72 against deterioration. The damper guide 71 is made of, for example, metal such as iron or stainless steel. The upper surface of the damper guide 71 is a ring-shaped flat plate and, in the central portion thereof, there is formed a penetration hole through which the wire 13 can be penetrated. The outer peripheral portion of the ring-shaped flat plate of the damper guide 71 is turned back downwardly and, in the axial direction thereof, there is formed a small cylindrical portion. This small cylindrical portion is used to receive the deformation or movement of the elastic member 72 in the radial direction thereof which can be caused when the elastic member 72 receives the compression force of the coil spring 6.

Figure 7A:
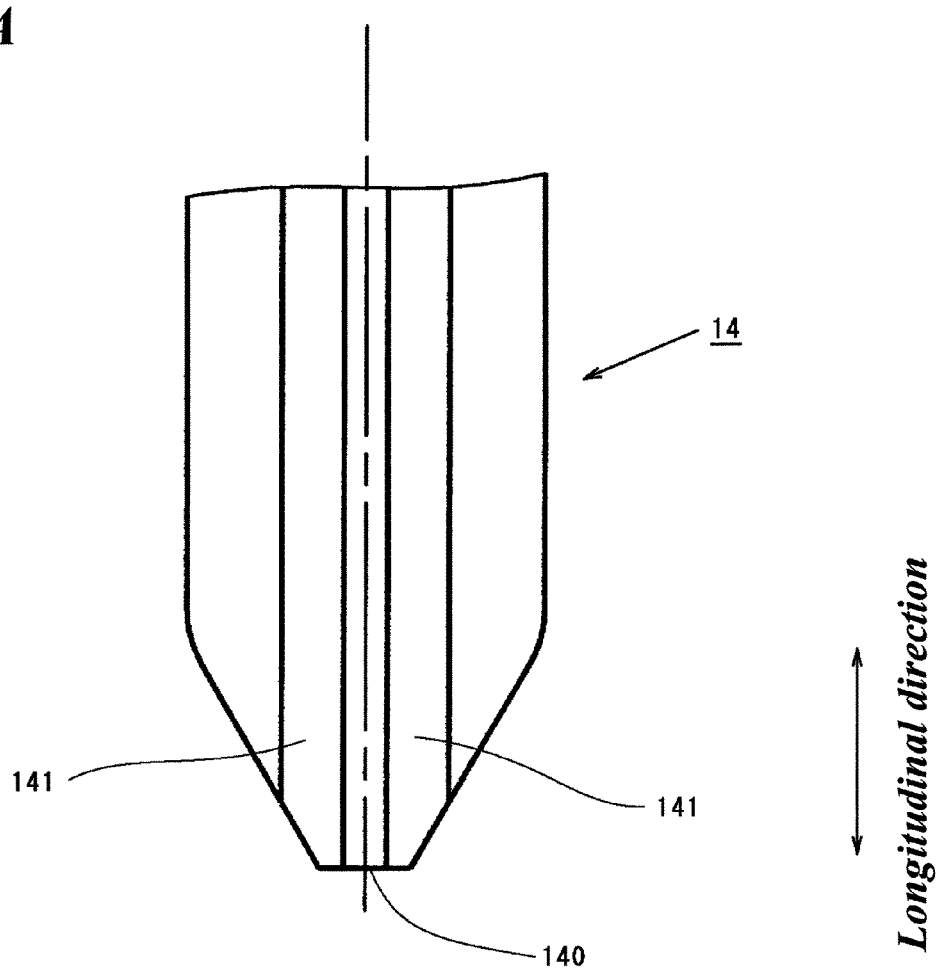
FIGS. 7A and 7B are views of a blade 14.
Figure 7B:
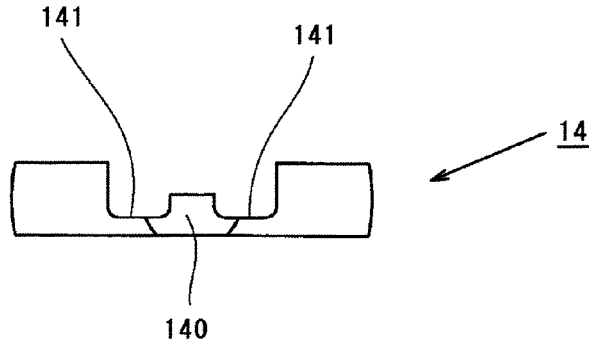

The blade 14 is a long and narrow plate-shaped member and has a shape which includes, in the longitudinal section thereof, recessed grooves on both sides of the center axis thereof. Description will be given below of the shape of the blade 14 with reference to FIGS. 7A and 7B. FIG. 7A is a back view of the leading end portion (lower end portion) of the blade 14, that is, a view thereof when it is viewed from behind FIG. 1; and, FIG. 7B is a section view of the B-B portion shown in FIG. 7A. The recessed grooves 141 of the blade 14 correspond in shape to the two side walls of two guide grooves (not shown) used to guide the nail 11; and, the blade 14 can be moved in the vertical direction in such a manner that it straddles over two projecting portions formed as the guide grooves. And, at the longitudinal direction lower end portion 140, the blade 14 is contacted with the nail 11 to strike it. In order not only to prevent, after the nail 11 is struck into a nailing-receiving member, the nail struck trace in the nailing-receiving member from increasing in size greatly but also to be able to increase the strength of the leading end portion of the blade 14 as much as possible, the leading end of the blade 14, when it is viewed in the longitudinal direction thereof, is narrowed; and, the leading end portion of the blade 14 is formed to have a substantially triangular shape having about 60° from the outer edge thereof to the leading end.

Referring back again to FIG. 1, the ejection portion 7 is disposed downwardly of the body portion 2*a* of the housing 2. Onto the ejection portion 7, there is mounted the magazine 8 which is used to feed the nail 11. The magazine 8 stores therein multiple nails 11, is energized by a spring in the feed direction (the direction going from back to front) and includes a feed member (not shown) for moving the nails 11.

When striking the nail using the nailing machine 1, an operator may hold the handle portion 2*b* in such a manner that the moving direction of the blade 14 of the nailing machine 1 is set substantially perpendicularly to the upper surface of a nailing-receiving member W, and may then pull the trigger 21 to thereby start the motor 3. When the motor 3 is started, the rotation force of the motor 3 is transmitted from the first pulley 17 through the belt 18 to the second pulley 19, and the rotation of the second pulley 19 is reduced by the deceleration mechanism 10 before it is transmitted to the clutch mechanism 4. Since, at the initial stage of the rotation, the clutch mechanism 4 is connected, the drum 5 is rotated. The drum 5 is rotated in a direction where the wire 13 is wound, whereby the plunger 9 is moved up to the top dead center and the coil spring 6 is compressed to store elastic energy therein.

At the time when the plunger 9 reaches the top dead center, the clutch mechanism 4 is cut off, thereby removing the mutually connected state between the fourth gear 104 and drum 5. As a result of this, since the drum 5 is free to rotate, there disappears an energizing force which goes in the compressing direction of the coil spring 6, and the elastic energy stored in the coil spring 6 is released, whereby the plunger 9 is suddenly pushed down toward the bottom dead center. As a result of this, the blade 14 fixed to the plunger 9 strikes the nails 11 fed into the guide grooves to drive the nails 11 into the nailing-receiving member W. The moving energy of the plunger 9 is absorbed by the repulsive forces of the nails 11 and also by the collision of the plunger 9 with the bumper 76.

Figure 2:
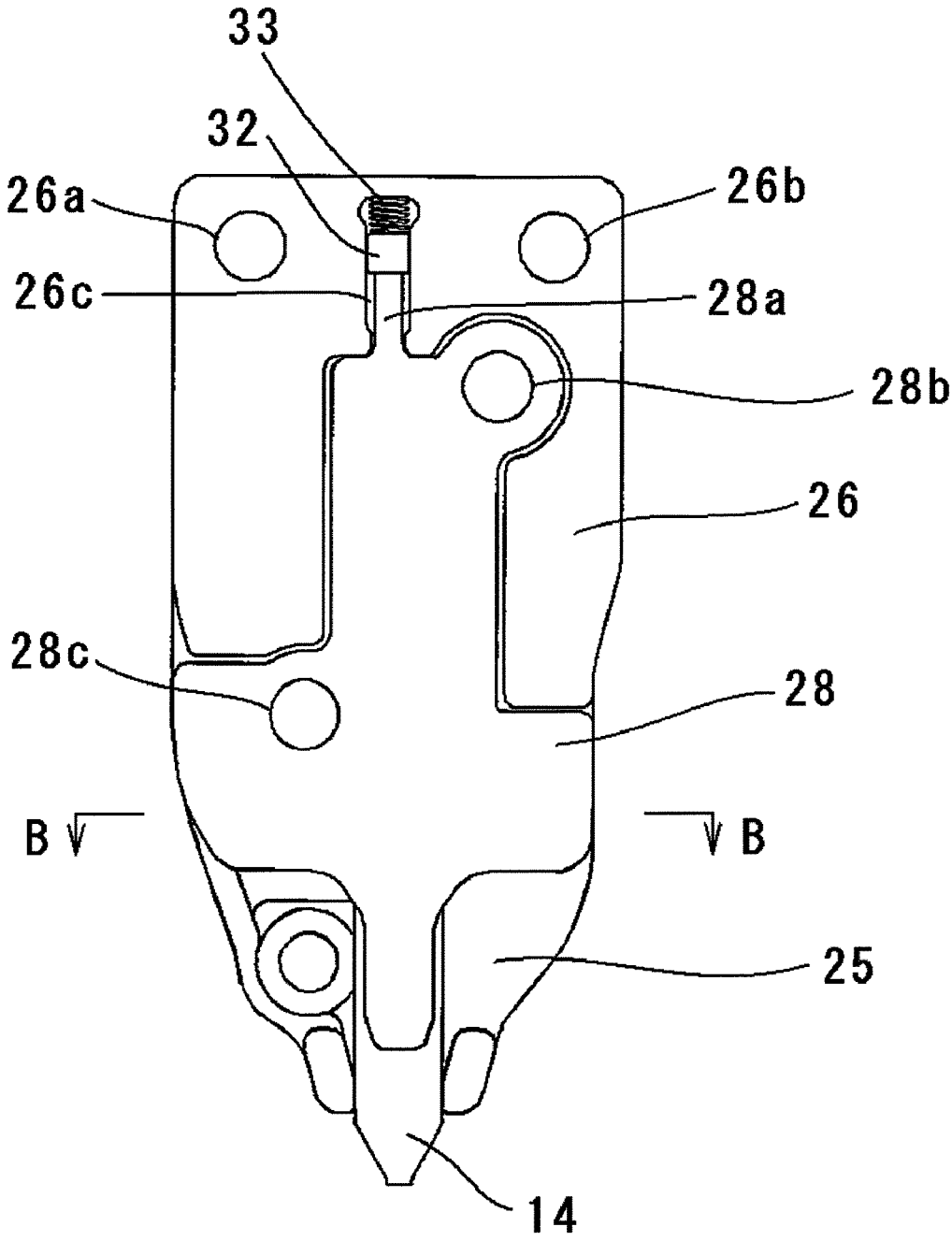
FIG. 2 is a front view of an ejection portion 7, showing a state where a movable guide plate to be mounted onto a blade guide 25 and a lock plate 30 to be mounted onto a plate 26 are removed.

Next, description will be given below of the details of the shape of the ejection portion 7 of the nailing machine 1. FIG. 2 is a front view of the ejection portion 7 when it is viewed from front, showing a state where there are removed therefrom a contact guide 29 (FIG. 1) to be mounted onto a blade guide 25 and a lock plate 30 (FIG. 1) to be mounted onto a plate 26. The ejection portion 7 includes the blade guide 25 having the guide grooves of the blade 14, the plate 26 to be fixed to the blade guide 25 in such a manner to cover the front surface of the blade 14, and a guide plate 28 forming a portion of a passage through which the blade 14 can be guided. The plate 26 has a substantially upside down inverted U-like shape in the state of FIG. 2, includes two hole portions 26*c* formed in the upper portion of the plate 26 and extending substantially side by side in the upward direction, and further two screw holes 26*a*, 26*b*. On the hole portions 26*c*, there is put a needle roller 36*c*; and, the needle roller 36*c* can be energized in the injecting direction (in the downward direction) by a spring 33. The respective front portions of the hole portions 26*c*, needle roller 32 and spring 33 are covered with a lock plate 30 (FIG. 1). The lock plate 28 is fixed together with the plate 26 by two screws through the screw holes 26*a* and 26*b*. The guide plate 28 includes a projection portion 28*a* provided on and projected from the upper end portion thereof; and, the guide plate 28 can be fixed to the blade guide 25 by screws through screw holes 28*b* and 28*c*. When the guide plate 28 is fixed, the projection portion 28*a* moves the needle roller 32 upwardly against the force of the spring 33.

Figure 3:
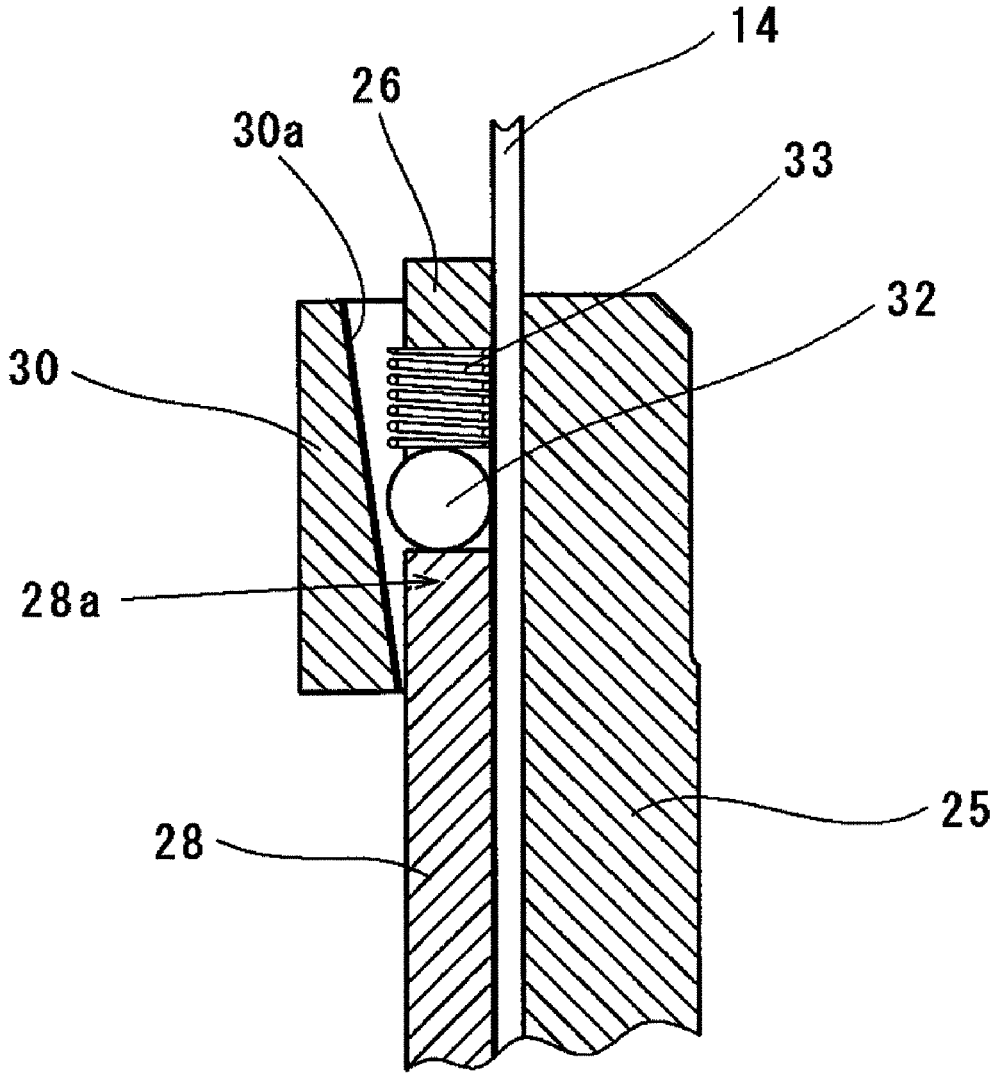
FIG. 3 is a partial section view of a blade fixing unit employed in the nailing machine according to the embodiment.

FIG. 3 is a partial section view of the neighborhood of the A portion shown in FIG. 1, showing the position relationship of the needle roller when the nailing machine 1 is put into operation. FIG. 3 shows a normal state in which the nail can be struck. In the hole portions 26*c* (see FIG. 2) of the plate 26 situated on the front surface side of the blade 14, there is disposed the needle roller 32; and, the needle roller 32 is energized downwardly by the spring 33 which is compressed. In the inner wall portion of the lock plate 30 that exists on the front surface side of the needle roller 32 and extends in the range where the needle roller 32 can move, there is formed an inclined surface portion 30*a* in such a manner that the distance between the inclined surface portion 30*a* and the front surface of the blade 14 becomes narrower in the downward direction. The angle of the inclined surface portion 30*a*, preferably, may be set for an angle of about 10° to the front surface of the blade 14.

When the needle roller 32 is moved downwardly, due to the operation of the inclined surface 30*a*, the needle roller 32 moves in a direction where it approaches the blade 14. Here, the needle roller 32 and spring 33 are simply disposed within an area which is defined by the front surface side of the blade 14, the hole portions 26*c* of the plate 26 and lock plate 30, but they are not fixed to other members by adhesion or the like. In FIG. 3, the needle roller 32 is held by the projection portion 28*a* of the guide plate 28 at a position where it compresses the spring 33.

Figure 4:
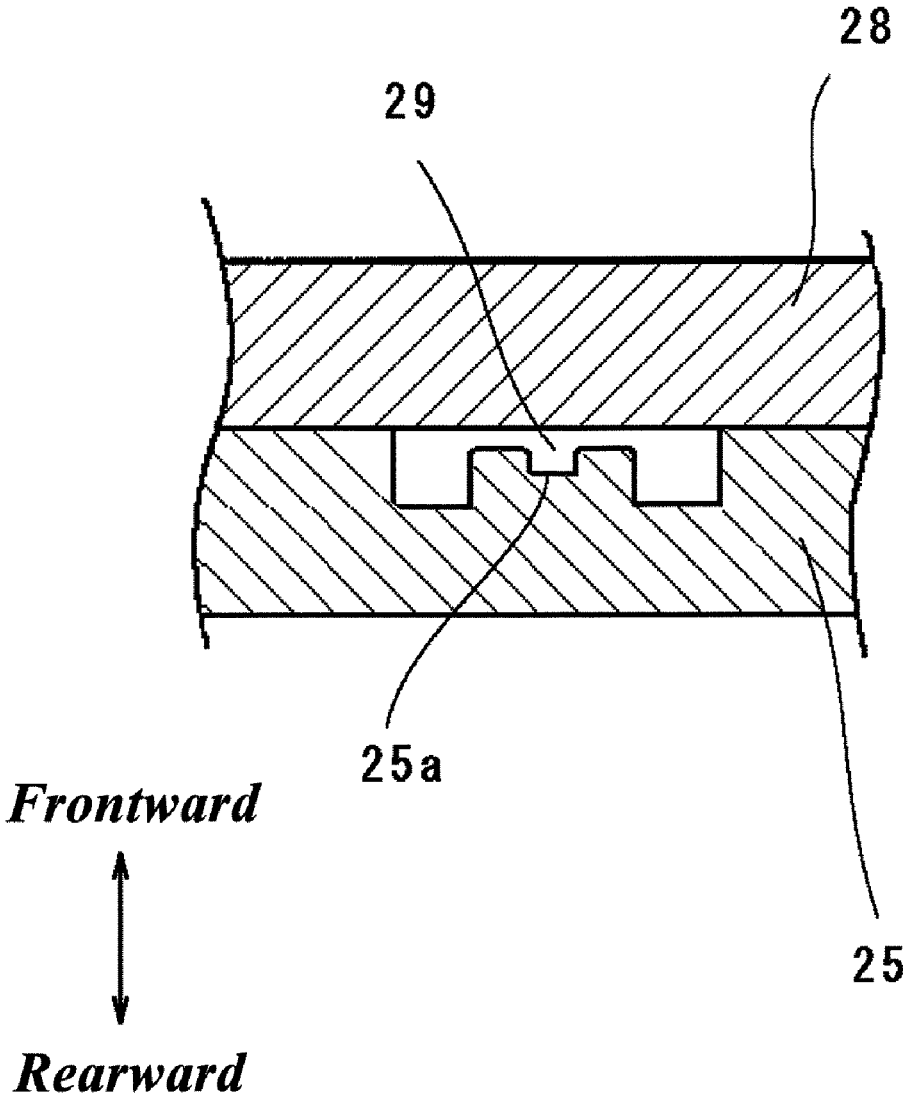
FIG. 4 is a partial section view off the B-B portion shown in FIG. 3.

FIG. 4 is a section view of the B-B portion shown in FIG. 2, showing the section shape of a guide passage through which the blade 14 can be guided. A guide passage 29 is defined by a guide groove 25*a* formed in the blade guide 25 and the plane of the rear side of the guide plate 28; and, the nail 11, when injected, is allowed to pass through the central groove of the blade guide 25.

Figure 5:
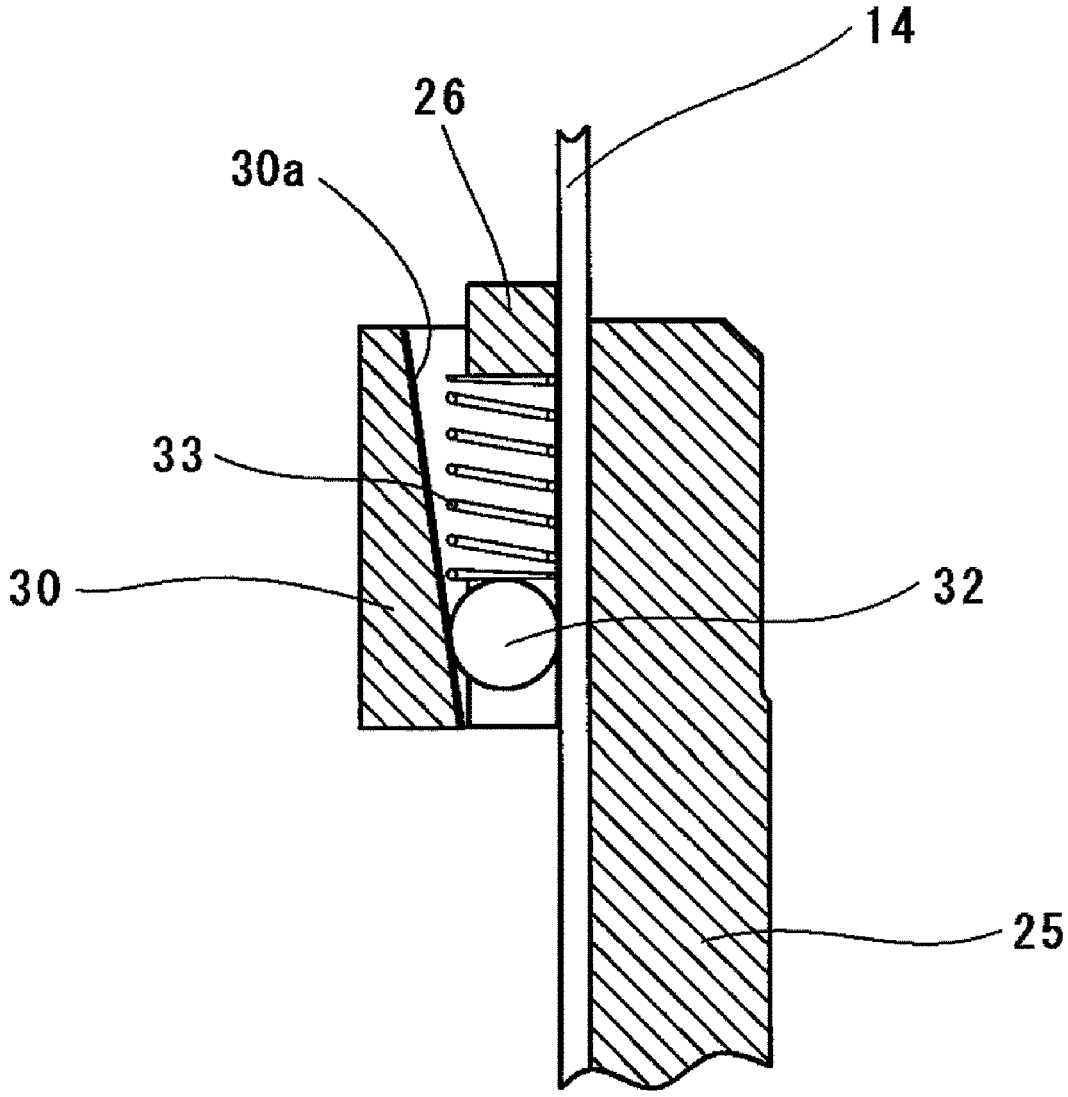
FIG. 5 is a partial section view of the blade fixing unit of the nailing machine according to the embodiment, showing a state where the blade guide 25 is removed.

FIG. 5 is a partial section view of the neighborhood of the A portion shown in FIG. 1, showing a state where, for some reason such as nail clogging, an operator has removed screws mounted into the screw holes 28*b* and 28*c* and has thereby removed the guide plate 28. When removing the nail stopped up between the blade 14 and blade guide 25, the operator must remove the screws, remove the guide plate 28 and expose the surface of the blade 14. When the guide plate is removed, there disappears the operation of the projection portion 28*a* to hold the needle roller 32 from bottom to top, whereby the needle roller 32 is energized downwardly by the spring 33 and is thereby moved downwardly, so that the needle roller 32 is contacted with the inclined surface portion 30*a* of the lock plate 30 and the front surface of the blade 14. In this state, the needle roller 32 is caught between the blade 14 and inclined surface portion 30*a*; and, therefore, even when the blade 14 is going to move downwardly, it is prevented against such downward movement since it is fixed by the needle roller 32 due to a frictional force resulting from the wedge effect of the needle roller 32. Accordingly, when the operator tries to remove the clogging nail, there is no possibility that the blade 14 can be moved energetically in the downward direction. That is, since there is provided a blade fixing unit which, when the guide plate 28 is removed, limits the movement of the blade 14, when removing the clogging nail in the guide passage 29 to remove the nail clogging state, the blade 14 can be prevented from moving energetically in the downward direction.

Here, in a state where the movement of the blade 14 is locked as shown in FIG. 5, if the operator should pull the trigger 21, the motor 3 may be started, the wire 13 may be then wound up and the blade 14 may be moved upwardly. However, even when the blade 14 is moved upwardly, since the needle roller 32 can move upwardly with the movement of the blade 14 and thus cannot be caught between the inclined surface portion 30*a* and blade 14, the upward movement of the blade 14 is not limited and thus no excessive force can be applied to the wire 13. Also, even, after the plunger 9 moves up to the top dead center, the transmission of the output is cut off by the clutch mechanism 4, the needle roller 32 moves downwardly with the movement of the blade 14 and is caught between the inclined surface portion 30*a* and blade 14, thereby locking the downward movement of the blade 14 immediately. This can prevent the blade 14 from moving energetically in the downward direction. Here, in order to fix the blade 14 in the above-mentioned manner, it is important that, in a state where the plunger 9 is raised up to the top dead center, the needle roller 32 is situated at a position higher than the lower end portion 140 of the blade 14.

As has been described heretofore, according to the present embodiment, since, when the guide plate 28 is removed, the downward movement of the blade 14 can be fixed, when removing the nail stopped up in the guide passage 29, the blade 14 can be prevented from moving energetically in the downward direction and thus the stopped-up nail can be prevented from flying around.

Figure 6:
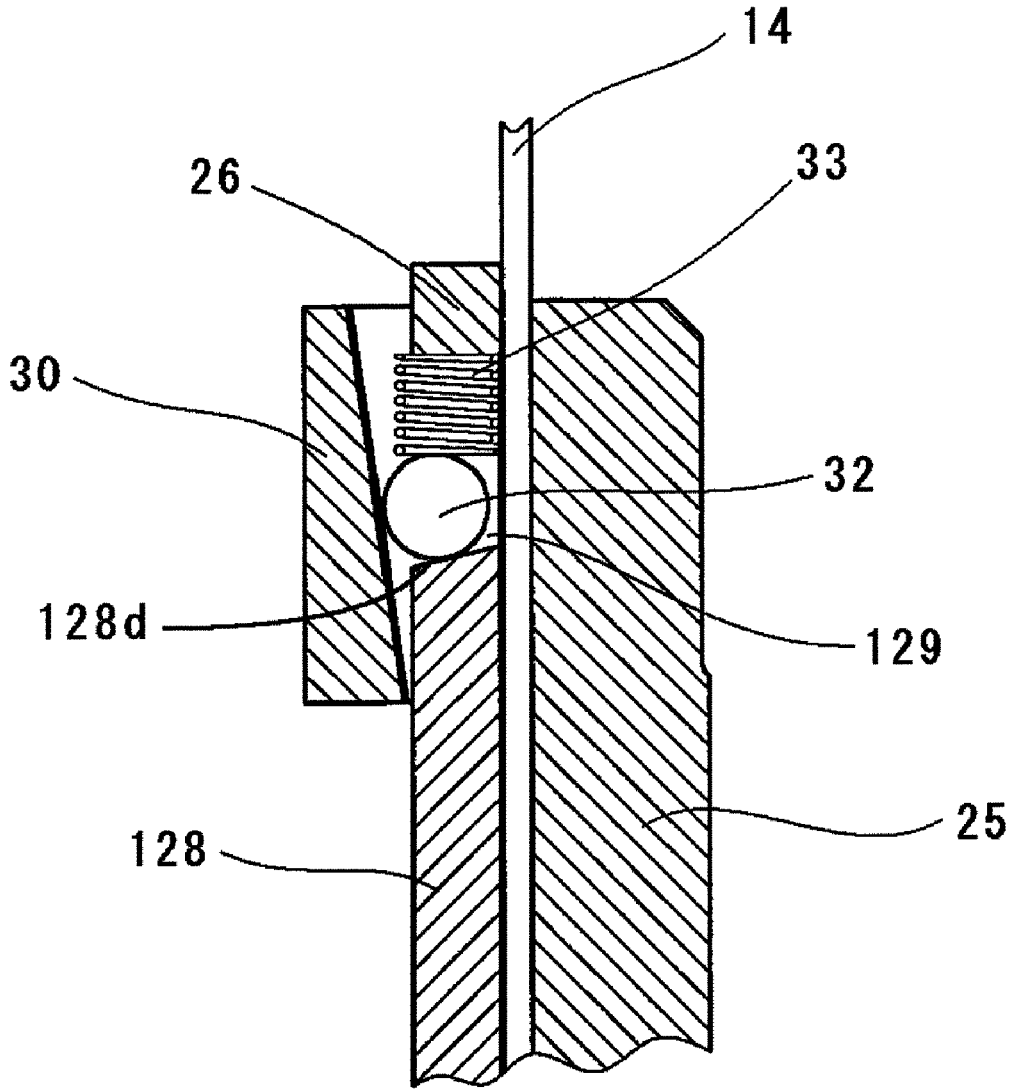
FIG. 6 is a partial section view of a blade fixing unit of a nailing machine according to a modification of the embodiment.

Next, description will be given below of a modification of the present embodiment with reference to FIG. 6. The present modification is different from the embodiment described with reference to FIG. 3 in the shape of the projection portion of a guide plate 128 in which the upper surface of the guide plate 128 to be contacted with the needle roller 32 is formed as an inclined surface portion 128*d*. The inclined surface of the inclined surface portion 128*d* is formed such that it lowers as it approaches the lock plate 30. Owing to this form of the inclined surface portion 128*d*, in a normal nail striking operation, as shown in FIG. 6, the needle roller 32 is situated at a position where it can be contacted with the lock plate 30, whereby there exists a gap 129 between the needle roller 32 and blade 14. Therefore, in the normal nail striking operation, since the blade 14 is not contacted with the needle roller 32, a loss in the nail striking operation can be prevented positively.

Although the present invention has been described heretofore with reference to the embodiment thereof, the invention is not limited to the above-mentioned embodiment but various changes are possible without departing from the scope of the subject matter of the invention. For example, as the power source of the nailing machine according to the invention, there can be used not only an electric power source but also other various power sources such as compressed air or gas. Also, although, in order to solve the nail clogged state of the blade 14, there is provided a blade fixing unit which, when any one of parts is removed, can limit the movement of the blade, the blade fixing unit is not limited to a structure which includes a spring and a needle roller, but it can also be realized by a metal ball, a pressure member, or other arbitrary fixing member or locking member. Further, although the blade fixing unit according to the embodiment is structured such that it can limit only the downward movement of the blade, it may also be structured such that it can limit the upward and downward movements of the blade.

What is claimed is:

1. A nailing machine, comprising:

a drive unit that drives a blade to strike a nail;

a blade guide forming a portion of a passage through which the blade is guided;

a guide plate that is attached on the blade guide to cover the portion of the passage;

a magazine that is held with respect to the blade guide and that feeds a nail to the passage, wherein the nailing machine further includes a blade fixing unit that limits a movement of the blade when the guide plate is detached; and a plate member that is disposed to be adjacent with the guide plate, wherein the blade fixing unit is interposed between the guide plate and the plate member, wherein the blade fixing unit includes:

a contact member; and a spring that urges the contact member, wherein the spring and the contact member are delimited in a space defined by the blade, the guide plate and the plate, and are covered with a lock plate, wherein the lock plate includes an inclined surface portion facing a surface of the blade above which the contact member is disposed, wherein the inclined surface is formed so that a distance between the inclined surface portion of the lock plate and the surface of the blade decreases toward a nail ejection direction, and wherein the contact member moves along the inclined surface portion due to an urging force of the spring so as to be caught between the inclined surface portion and the blade, thereby fixing the movement of the blade.

2. The nailing machine of claim 1, wherein the inclined surface portion has an angle of around 10° with respect to the blade surface.

3. The nailing machine of claim 1, wherein the plate includes a hole portion, wherein the guide plate includes a projection portion, wherein the space between the guide plate and the plate includes a space between the hole portion and the projecting portion, and wherein, when the guide plate is attached to the blade guide, the projecting portion pushes the contact member being caught between the inclined surface portion and the blade against the urging force of the spring to thereby release the limit of the movement of the blade.

4. A nailing machine, comprising:

a drive unit that drives a blade to strike a nail;

a blade guide forming a portion of a passage through which the blade is guided;

a guide plate that is attached on the blade guide to cover the portion of the passage; and a magazine that is held with respect to the blade guide and that feeds the nail to the passage; wherein the nailing machine further includes a blade fixing unit, wherein the guide plate contacts the blade fixing unit, and wherein the blade fixing unit limits a movement of the blade when the guide plate is detached from the blade fixing unit.

5. A nailing machine, comprising:

a drive unit that drives a blade to strike a nail;

a blade guide forming a portion of a passage through which the blade is guided;

a guide plate that is attached on the blade guide to cover the portion of the passage; and a magazine that is held with respect to the blade guide and that feeds the nail to the passage; and a blade fixing unit that further limits a movement of the blade when the guide plate is detached, wherein the blade fixing unit includes:

a contact member; and a spring that urges the contact member, wherein the spring and the contact member are covered with a lock plate, wherein the lock plate includes an inclined surface portion facing a surface of the blade above which the contact member is disposed, and wherein the contact member moves due to an urging force of the spring so as to be caught between the inclined surface portion and the blade thereby fixing the movement of the blade.

6. A nailing machine, comprising:

a driving unit that drives a blade to strike a nail;

a blade guide forming a portion of a passage through which the blade is guided:

a guide plate that is attached on the blade guide to cover the portion of the passage;

a magazine that is held with respect to the blade guide and that feeds the nail to the passage; and a blade fixing unit that limits a movement of the blade when the guide plate is detached, wherein the blade fixing unit includes:

a contact member; and a spring that urges the contact member toward a direction that the driver blade moves when the driver blade strikes the nail.

* * * * *